United States Patent [19]

Bechem et al.

[11] Patent Number: 4,634,504

[45] Date of Patent: Jan. 6, 1987

[54] PROCESS FOR THE ELECTRODEPOSITION OF METALS

[75] Inventors: Werner Bechem, Hilchenbach; Hubertus Peters, Dortmund; Werner Solbach, Wallmenroth; Dietrich Wolfhard, Dortmund, all of Fed. Rep. of Germany

[73] Assignee: Hoesch Aktiengesellschaft, Dortmund, Fed. Rep. of Germany

[21] Appl. No.: 670,408

[22] Filed: Nov. 9, 1984

[30] Foreign Application Priority Data

Nov. 10, 1983 [DE] Fed. Rep. of Germany ..... 3340732

[51] Int. Cl.[4] ..... C25D 5/08; C25D 7/06

[52] U.S. Cl. ..... 204/28; 204/206

[58] Field of Search ..... 204/28, 206, 207, 208, 204/209, 210, 211

[56] References Cited

U.S. PATENT DOCUMENTS

| | | | |
|---|---|---|---|
| 2,317,242 | 4/1943 | Allen et al. | 204/206 |
| 2,673,836 | 3/1954 | Vonada | 204/28 |
| 3,975,242 | 8/1976 | Matsuda et al. | 204/28 |
| 4,183,799 | 1/1980 | Sellitto et al. | 204/206 |

*Primary Examiner*—John F. Niebling
*Assistant Examiner*—William T. Leader
*Attorney, Agent, or Firm*—Mueller and Smith

[57] ABSTRACT

The invention concerns a process for the electrodeposition of metals, especially zinc, on to metal strip, particularly steel strip, from an aqueous solution of the metal salts, using high relative flow velocities between electrolyte and strip and electrolyte and anodes, the metal strip being introduced vertically into the electrolyte, turned around and led vertically out of the electrolyte. A process of this nature should enable high current densities to be employed, including in vertical cells in which the metal strip, in particular steel strip, is passed vertically through the electrolyte, and permit even relative flows between the metal strip and the electrolyte, thus producing even deposition conditions for the parts of the metal strip entering and leaving the cell. The invention proposes that the electrolyte is forced to flow against the direction of strip travel throughout the section between the anodes and the metal strip. The equipment envisaged for carrying out the process is designed so that the electrolytic cell (1) is fitted with shaft-shaped sections (8, 12) for the strip entrance (8) and exit (12), within which sections (8, 12) the anodes (9, 11) are arranged parallel to each other and to the metal strip (6), and the sections (8, 12) are connected by a communicating lower part of the cell (13), and the top of the section (8) for the strip entrance is set lower than the top of the section (12) for the strip exit by the dimension Δ h.

8 Claims, 5 Drawing Figures

PROCESS FOR THE ELECTRODEPOSITION OF METALS

Figure 1:
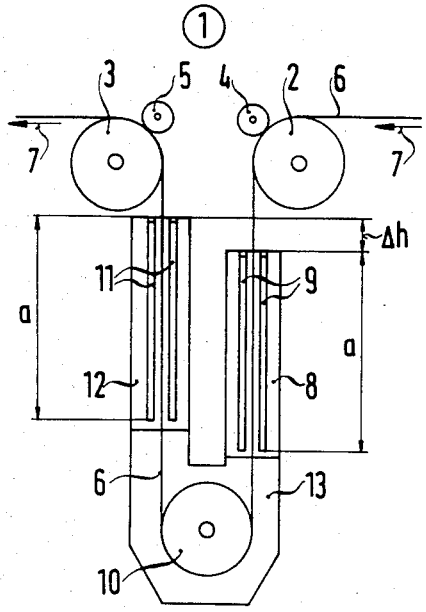

The invention concerns a process for the electrodeposition of metals, especially zinc, on to metal strip, particularly steel strip, from an aqueous solution of the metal salts using high relative flow velocities between electrolyte and strip and electrolyte and anodes, the metal strip being introduced vertically into the electrolyte, turned around and led vertically out of the electrolyte, and also equipment for carrying out this process, with the entrance and exit for the metal strip arranged vertically above the electrolytic cell, both entrance and exit being provided with one guide roller and/or a current transmission roller, and the metal strip being passed around a submerged roller in the lower part of the electrolytic cell and between anodes in the entrance and exit sections.

Various designs of processes for the electrodeposition of metals on to metal strip are known, the strip being passed horizontally, radially or vertically through the plating zone.

One particular process, known from the published AT patent application A No. 3014-82, is for the continuous coating with metal by electrolytic means of one or both sides of a metal strip, the direction of travel of which deviates from the horizontal, in which the electrolyte flows between at least one plate-shaped anode and the metal strip, this being the cathode, the process being characterised by the fact that the electrolyte runs in freely in the upper region of the anode and flows downwards under the influence of gravity, forming a closed flow volume in the space between the anode and the metal strip, the electrolyte in the space being continually topped up.

In this known process, in which the anodes do not dip into the electrolyte bath, the electrolyte is directed in the opposite direction to the metal strip leaving the eletrolytic cell (counterflow), and in the same direction as the metal strip entering the cell (following flow). Apart from the fact that this process is only appropriate for use if the distance between the anode and cathode, i.e. the metal strip, does not exceed 2–20 mm and is preferably 10 mm, because otherwise the quantities of electrolyte to be pumped become far too great, this known process leads to differing flow conditions at the metal strip entering and leaving the cell, and therefore to differing deposition conditions.

In a further process proposed by the applicant No. (P 32 28 641.4) for the electrodeposition of metals on to steel strip from aqueous solutions of the metal salts, using high relative flow velocities between electrolyte and steel strip and anodes in order to achieve higher current densities with as low an energy application as possible, a thin diffusion layer thickness is achieved by inducing a turbulent flow condition in the electrolyte flowing parallel to the steel strip by using subsidiary electrolyte flows transverse to the direction of strip travel. In this process as well, the electrolyte is directed in the opposite direction to the metal strip leaving the cell and in the same direction as the strip entering the cell.

In all these known designs of electrodeposition processes, the current density can only be matched to the varying relative flow velocities in the entrance and exit sections of the electrolytic cell, corresponding to the entering and leaving parts of the metal strip, by increased expenditure. Consequently, it is difficult if not impossible to achieve even deposition conditions in both these parts of the electrolytic cell.

The invention is based on the need to design a process and equipment of the type mentioned at the beginning which would enable high current densities to be employed, including in vertical cells in which the metal strip, in particular steel strip, is passed vertically through the electrolyte, and which would permit even relative flows between the metal strip and the electrolyte, thus producing even deposition conditions for the parts of the metal strip entering and leaving the cell.

The invention fulfils this objective by forcing the electrolyte to flow against the direction of strip travel throughout the entire section between the anodes and the metal strip. The best method of achieving this is by increasing the electrolyte flow by raising the pressure, and it is advantageous here to increase the pressure in the entrance and/or exit section. A further design possibility of the invention is to add the electrolyte at the strip exit with a downwards velocity component, the electrolyte being pumped against the direction of strip travel, and also by producing a local partial vacuum in the cell.

The preferable equipment for carrying out the process described in the invention is constructed in such a way that the electrolytic cell is fitted with shaft-shaped strip entrance and exit sections; within these sections the anodes are arranged facing each other and the metal strip in the known manner, and the strip entrance and exit sections are connected to each other by a communicating lower part, and the top of the strip entrance section is set lower than the top of the strip exit section by a dimension $\Delta h$. Further preferred designs are given in the following description and the other claims.

The advantages of the invention are to be seen in particular in the fact that with a vertical direction of strip travel as well, a non-laminar flow of the electrolyte in the electrolysis zone is achieved both in the entrance and exit parts of the electrolytic cell, which leads initially to a reduction in the cathodic diffusion layer and the provision of an adequately large number of depositable ions and further to the use of higher current densities, preferably in excess of 60 $A/dm^2$ when galvanising steel strip, without "burning" the metal (zinc) layer deposited, and also to an increase in the speed of deposition. Moreover, at the same time, particles present in the electrolyte are prevented from settling on the metal strip and/or reaching the region of the current transfer rollers. Accordingly, a perfect surface of the metal deposit is ultimately reached more quickly and with simpler means than with state-of-the-art equipment.

Overall, the process operates with a relative flow velocity of between more than 0.5 and 2.5, preferably 3.0, m/sec., the relative flow velocity representing the velocity differential between the metal strip velocity and electrolyte flow velocity.

The process as described in the invention is illustrated in the drawings by way of preferred designs of the plant, FIGS. 1 to 5 showing various versions of electrolytic cells in schematic form with the metal strip entering and leaving.

As can be seen in FIGS. 1 to 5, the metal strip entrance and exit sections into and out of the electrolytic cell, which is generally marked as 1, are both provided with one guide roller 2, 3, and one current transfer roller, 4, 5, above them. The metal strip 6 for plating or galvanising passes in the direction of the arrow 7 between the guide roller 2 and current roller 4, which transfers the current to the metal strip 6, e.g. a steel strip, by linear contact, continues downwards in the entrance section between the anodes 9, passes round the submerged roller 10 and then travels upwards between the anodes 11 into the exit section. After leaving the exit section 12 of the electrolytic cell the metal strip is led between the guide roller 3 and the current roller 5 to the next electrolytic cell, for example. Either soluble or inert anodes 9, 11, can be used. As an alternative, current transfer rollers can be used in place of the guide rollers 2 and 3, in which case the current rollers 4 and 5 can be dispensed with.

Figure 2:
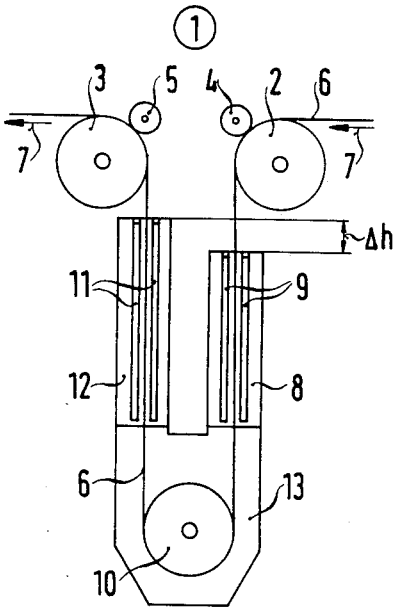
Figure 3:
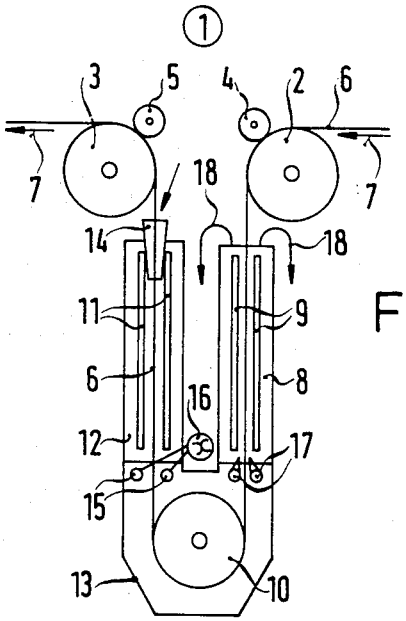

Further, as FIGS. 1 to 5 show, both the entrance section 8 and the exit section 12 are designed as shaft-shaped, and these sections 8 and 12 are connected with each other by a communicating lower part 13 in which a submerged roller 10 is located. Furthermore, the top of the entrance section 8 is arranged lower than the top of the exit section 12 by a dimension Δh. If the electrolyte liquid is filled in through an inflow funnel 14 in the exit section 12, as shown in FIG. 3, an electrolyte flow against the direction of strip travel will result when the strip passes through the electrolytic cell 1, i.e. in the exit section 12 the flow is downwards and in the entrance section 8 the flow is upwards. Consequently, the electrolyte comes out at the top of the entrance section 8, as indicated by the arrow 18. The value for the dimension Δh is given by the desired flow velocity and the flow losses for the electrolyte in the exit section 12, in the lower part 13 and entrance section 8. The effective length of the anodes 9, 11, for coating or plating the metal strip 6 is given in FIG. 1 as a.

In the design of electrolytic cell shown in FIG. 2, the anodes are shortened by the value of Δh, so that the bottom of the anode 9 in the entrance section 8 is at the same height as that of the anodes 11 in the exit section 12.

In order to achieve an optimum length for the anodes 9 in the entrance section 8, i.e. as long a deposition length as possible, inflow funnels 14 are provided for the electrolyte in FIG. 3 in the exit section 12 of the metal strip 6. If the electrolyte is filled through these funnels, which extend in between the anodes 11, an increased electrolyte flow velocity results in the exit section 12 between the metal strip 6 and the anodes 11 against the direction of travel of the metal strip 6.

To ensure that this flow against the direction of travel of the strip is maintained at all points in the electrolytic cell and that the necessary height differential Δh can be kept small, extraction pipes 15 and a pump 16 are installed below the anodes 11, by means of which electrolyte is drawn off and pumped under pressure through feeder pipes 17 in to the entrance section 8 under the anodes 9. This generates an additional upwards flow component in the entrance section 8 which virtually compensates for flow losses. The arrow 18 indicates the overflowing electrolyte.

Figure 4:
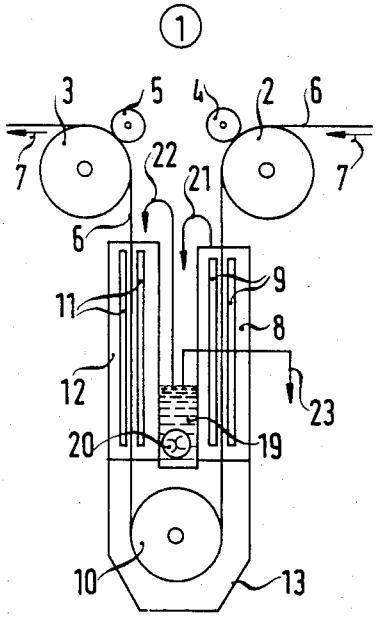

In another design example in FIG. 4—as in FIG. 3—the part of the electrolytic cell 1 between the entrance and exit section 8 and 12 is configured as an overflow reservoir 19, in which a pump 20 is arranged. The electrolyte overflowing from the entrance section 8 into the overflow reservoir 19—shown by the arrow 21—is pumped back in to the opening of the exit section 12 of the metal strip 6, as shown by the arrow 22. Consequently, only a small additional quantity of electrolyte, taken from a header tank not shown, needs to be pumped into the exit section 12 to produce or increase the required flow against the direction of strip travel.

By pumping in the electrolyte quantity at high velocity, however, the height differential necessary to produce a flow can be reduced. The unwanted electrolyte quantity flows from the overflow reservoir 19 directly into the header tank (arrow 23).

Figure 5:
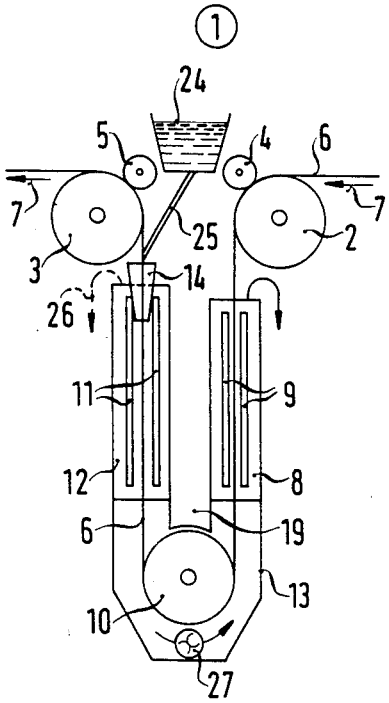

FIG. 5 shows a further design form of the invention. Here, a header tank 24 is installed above the electrolytic cell 1, with a connecting pipe 25 to the inlet funnels 14. The necessary flow energy in this electrolytic cell is generated by a directional electrolyte flow into the inlet funnels 14 of the exit section 12. In order to ensure that the exit section 12 is filled evenly, part of the electrolyte must continually overflow out of this section 12, as shown by the arrow 26. By means of a pump 27 arranged in the lower part 13 of the electrolytic cell 1 under the submerged roller 10, a pressure reduction is created below the shaft 12 and a pressure increase below the shaft 8, so that the height differential between the tops of the entrance and exit sections 8 and 12 can be kept very small. To reduce the overall pumping energy required, it is furthermore possible to pump a certain quantity of electrolyte directly into the header tank 24 with the pump 20 in the overflow reservoir 19.

We claim:

1. Process for the electrodeposition of a first metal onto a second metal strip from an aqueous electrolytic solution of a salt of said first metal contained in an electrolytic cell which cell also contains vertically disposed anodes in a feed section and in an exit section of said cell, wherein high relative flow velocities between the electrolytic solution and said strip and between the electrolytic solution and said anodes are maintained, the metal strip being introduced downwardly vertically into the electrolytic solution in said feed section, turned around in said cell and passed upwardly vertically in said exit section and out of said electrolytic cell, wherein the electrolytic solution is forced to flow counter current to the direction of the metal strip in said feed section and in said exit section, said electrolytic solution flow being obtained by a pressure increase due to a difference in height between the upper surface of the electrolytic solution in said exit section and the upper surface of the electrolytic solution in said feed section.

2. Process as in claim 1 wherein the electrolytic solution flow is obtained by a pressure increase at the bottom part of the feed section, the top part of the exit section, or both.

3. Process as in claim 1 wherein the electrolytic solution is supplied with a downward velocity component into the exit section of the cell or with an upward velocity component in the feed section of the cell.

4. Process as in claim 1 wherein the electrolytic solution flow is produced by a pressure increase obtained by pumping the electrolytic solution counter current to the direction of travel of the strip.

5. Process as in claim 1 wherein the electrolytic solution flow is increased by maintaining a local partial vacuum in the cell.

6. Process as in claim 5 wherein the electrolytic solution flow is increased by maintaining a local partial vacuum at the bottom part of the exit section.

7. Process according to claim 1 wherein the current density maintained in said electrolytic cell is in excess of $60A/dm^2$.

8. Process according to claim 1 wherein said first metal is zinc and said metal strip is steel strip.

* * * * *